US007226398B2

(12) United States Patent
Fu

(10) Patent No.: US 7,226,398 B2
(45) Date of Patent: Jun. 5, 2007

(54) APPARATUS FOR PRACTICING ART OF ATTACK AND DEFENSE

(76) Inventor: Han-Ming Fu, 1st Floor, No. 15-33, Mingde 2nd Road, Cidu District, Keelung (TW) 206

( * ) Notice: Subject to any disclaimer, the term of this patent is extended or adjusted under 35 U.S.C. 154(b) by 0 days.

(21) Appl. No.: 11/263,933

(22) Filed: Nov. 2, 2005

(65) Prior Publication Data

US 2007/0099771 A1 May 3, 2007

(51) Int. Cl.
*A63B 69/34* (2006.01)

(52) U.S. Cl. ..... 482/85; 482/83

(58) Field of Classification Search ..... 482/83–90; D21/787, 798; 273/440.1
See application file for complete search history.

(56) References Cited

U.S. PATENT DOCUMENTS 1,703,012 A * 2/1929 McNamara ..... 482/90
2,197,545 A * 4/1940 Bachman et al. ..... 473/444
3,022,072 A * 2/1962 Zinnow ..... 482/90
4,903,966 A * 2/1990 Liao ..... 473/423
5,921,895 A * 7/1999 Lynch et al. ..... 482/83
6,090,018 A * 7/2000 Laudenslager et al. ..... 482/87
6,183,399 B1 * 2/2001 Chen ..... 482/90
6,790,167 B1 * 9/2004 Carlin et al. ..... 482/90

* cited by examiner

*Primary Examiner*—Jerome Donnelly
*Assistant Examiner*—Allana Lewin

(57) ABSTRACT

An apparatus for practicing art of attack and defense includes a base, an elastic force regulating set and a cylindrical member. The elastic force regulating set further includes a spring, a hollow cylinder and a Y-shaped hollow post. The hollow cylinder and the Y-shaped hollow post adjustably engage with each other with screw threads and distance between the hollow cylinder and the Y-shaped hollow post is capable of being regulated to create elastic force change for providing a specific elastic force needed by the user. The space in the base can be placed with a solid or injected liquid to offer steady center of gravity against being hit down. Further, the cylindrical member, the hollow cylinder and the Y-shaped hollow can be received in the base conveniently after use.

13 Claims, 7 Drawing Sheets

APPARATUS FOR PRACTICING ART OF ATTACK AND DEFENSE

BACKGROUND OF THE INVENTION

1. Field of the Invention

The present invention is related to an apparatus for practicing art of attack and defense and particularly to an apparatus, which is capable of being adjusted elastic force desired by the user during practicing skill with regard to art of attack and defense.

2. Brief Description of the Related Art

An apparatus for practicing art of attack and defense is available for the user to take a complete exercise concerning skill of art related to attack and defense. All parts in the conventional apparatus have to be joined to each other with screws and the base thereof has to be made of heavy material or stuffed with liquid in order to endure large foreign forces. Further, the conventional apparatus only provides a constant elastic force, which is incapable of being regulated suitable for the users' need.

In addition, the parts in the conventional device are independent of each other and it is very inconvenient in case of the apparatus being stored, delivered and packed. Further, the preceding problems incur a lot of expenses.

The preceding problems concerning storage, non-adjustable elastic force and high delivery cost are subjects worth us to care and overcome.

SUMMARY OF THE INVENTION

An object of the present invention is to provide an apparatus for practicing art of attack and defense, which includes a base, an elastic force regulating set and a cylindrical member. The base and the cylindrical members each have a hook member respectively to engage with both ends of an elastic device of the elastic force resulting set. The elastic force regulating set further provides a hollow cylinder, which is adjustably attached to a Y-shapes hollow post by means of screw threads. Length of the elastic device can be changed due to change of distance between the hollow cylinder and the Y-shaped hollow post. Thus, restoration of the elastic device depends on the length of the elastic device being changed. Of course, pull force generated by the restoration varies with tightness of the elastic device.

Further, the base has two opposite inlets for the cylindrical member being received in the base via the inlets. Besides, the hollow cylinder and the Y-shaped hollow post can be received in the base as well. A wheel set and a handle are attached to the base for assisting the base being carried conveniently.

The Y-shaped hollow post has an outward bend at the edge of the top thereof to prevent the top of the Y-shaped hollow post from being damaged due to friction created by oscillation resulting from being subjected to foreign forces such that life span thereof is able to extend effectively.

Moreover, it is not necessary to use any screws for joining the parts of the apparatus of the invention and the elastic force can be regulated with simply turning the Y-shaped hollow post.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
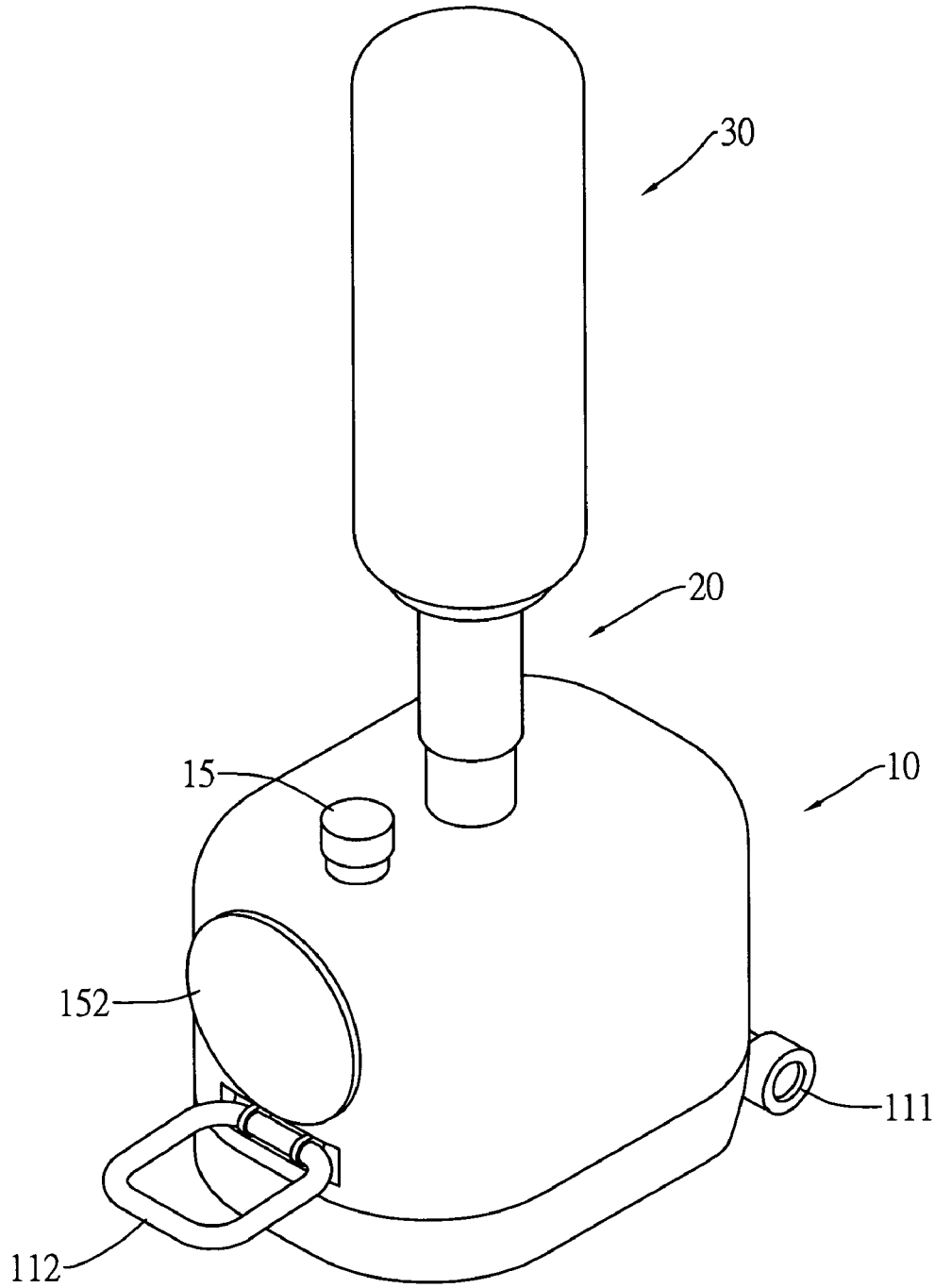
FIG. 1 is a perspective view of an apparatus for practicing art of attack and defense according to the present invention.
Figure 2:
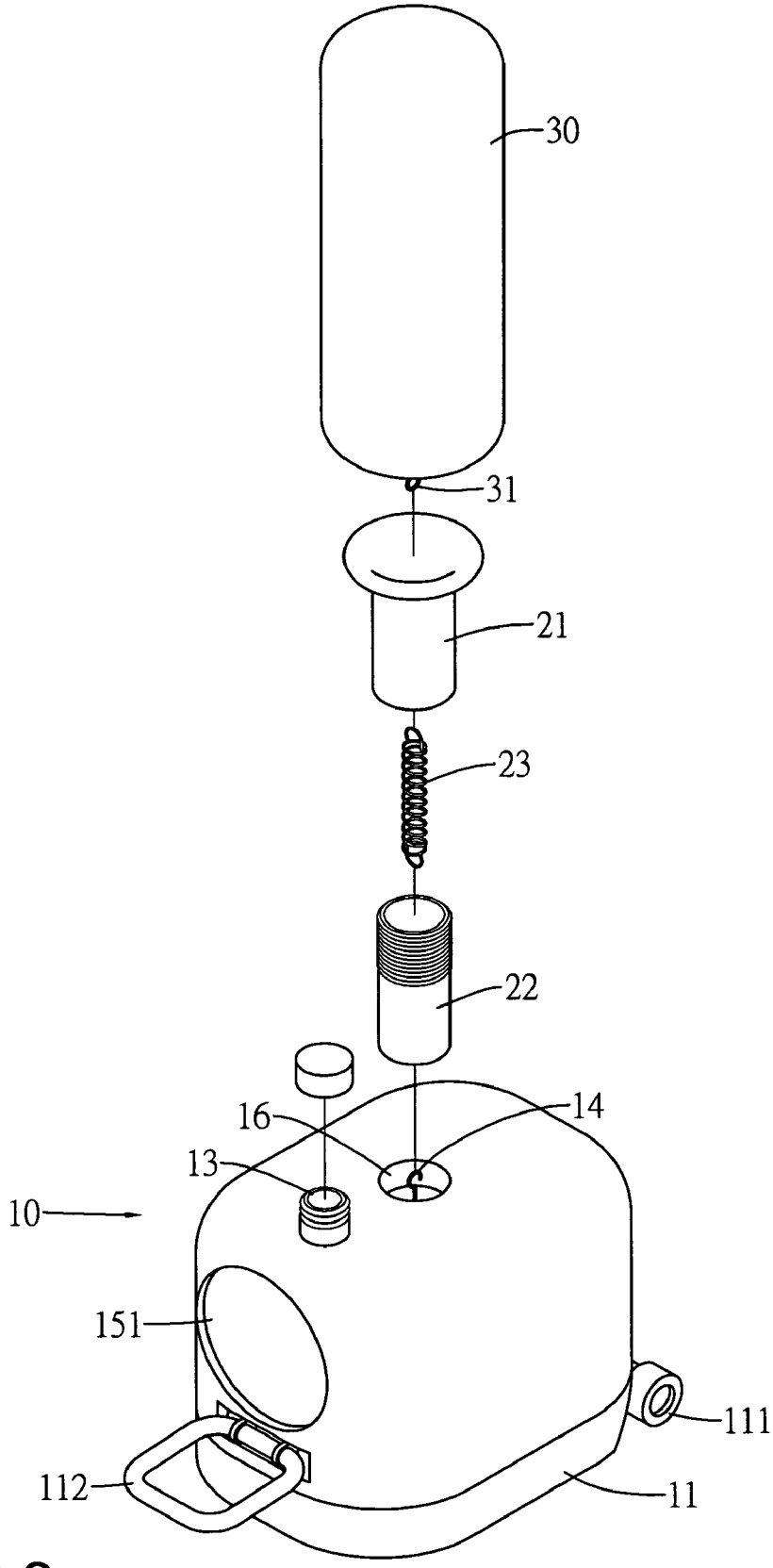
FIG. 2 is an exploded perspective view of the apparatus for practicing art of attack and defense shown in FIG. 1.
Figure 3:
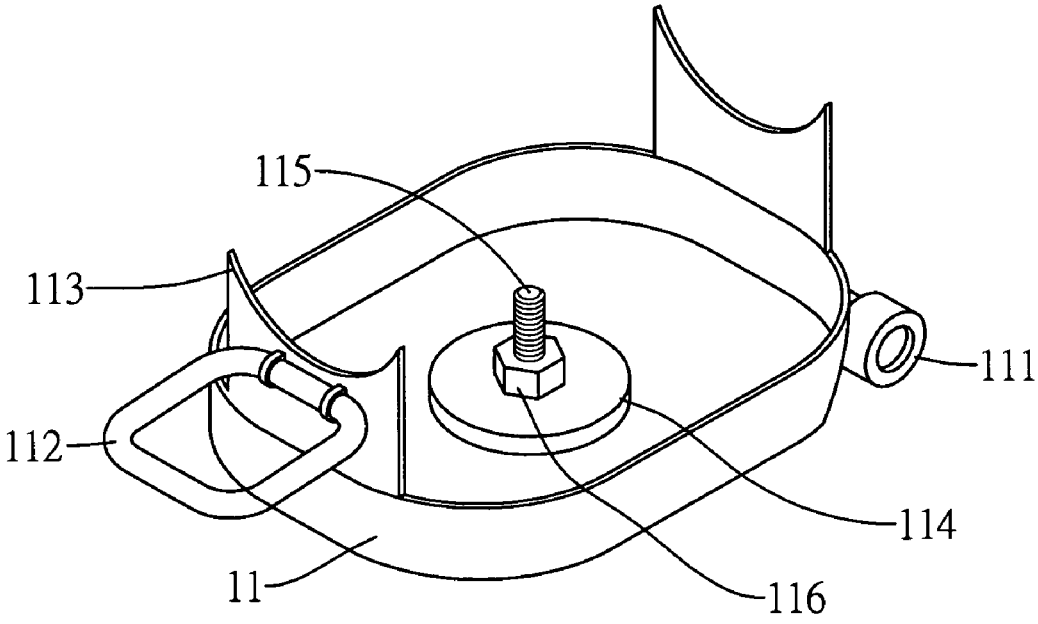
FIG. 3 is a perspective view of the base of the apparatus for practicing art of attack and defense according to the present invention.

Referring to FIGS. 1 and 2, an apparatus for practicing art of attack and defense according to the present invention includes a base 10, an elastic force regulating set 20 and a cylindrical member 30. The cylindrical member 30 provides a hook member 31 at the bottom thereof to engage with an end of a spring 23. The base 10 further includes a base bottom 11 and a casing 15. The casing 15 has two opposite inlets 151 at two lateral sides thereof, an inject opening 13 and a recess 16 at the top thereof and a handle 112 below one of the inlets 151. Further, a cover 152 is sealed to the respective inlet 151. Another hook member 14 is disposed in the recess 16 for engaging with another end of the spring 23. A wheel set 111 is located at the base bottom 11 for the apparatus being moved easily. A stud 115, which is shown in FIG. 3, is disposed at the center of the base bottom 11 to fasten an iron disk member 114 to the base bottom 11 for increasing weight of the base bottom 11. A nut 116 engages with the stud 115 against the iron disk 114 to avoid the iron disk member 114 loosening from the stud 115 during being subjected a foreign force.

The elastic force regulating set 20 includes a hollow cylinder 22, a Y-shaped hollow post 21 and a spring 23. The hollow cylinder 22 provides outer screw threads corresponding to inner screw threads of the Y-shaped hollow post 21 so that the hollow cylinder 22 is able to engage with the Y-shaped hollow post 21 and allow the Y-shaped hollow post 21 being controlled to move upward or downward. Further, the Y-shaped hollow post 21 has a circular top with the circumferential edge thereof bent outward such that less friction is created in case of hitting with the cylindrical member 30.

Figure 4:
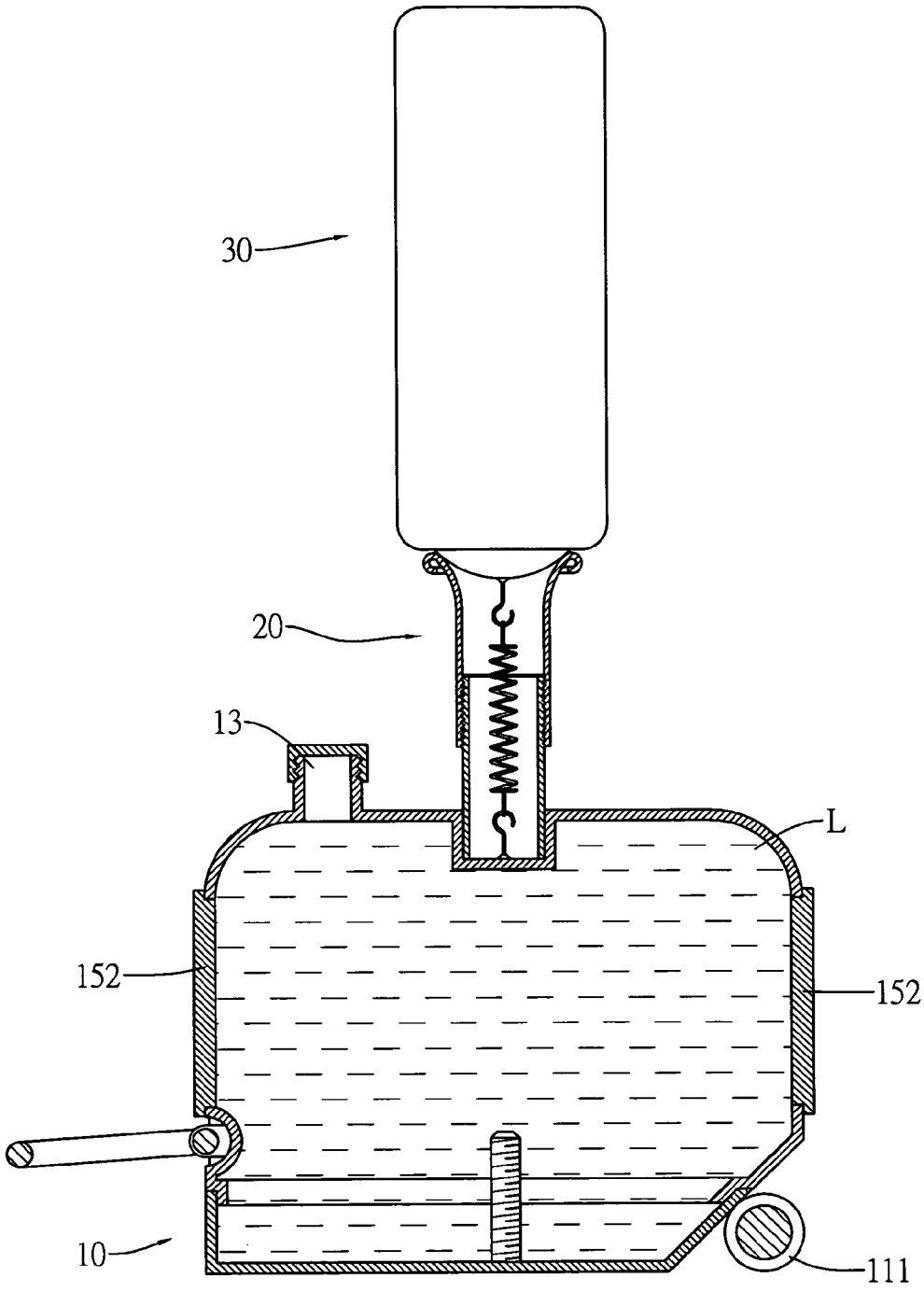
FIG. 4 is a sectional view illustrating a state of the apparatus for practicing art of attack and defense according to the present invention in use.
Figure 5:
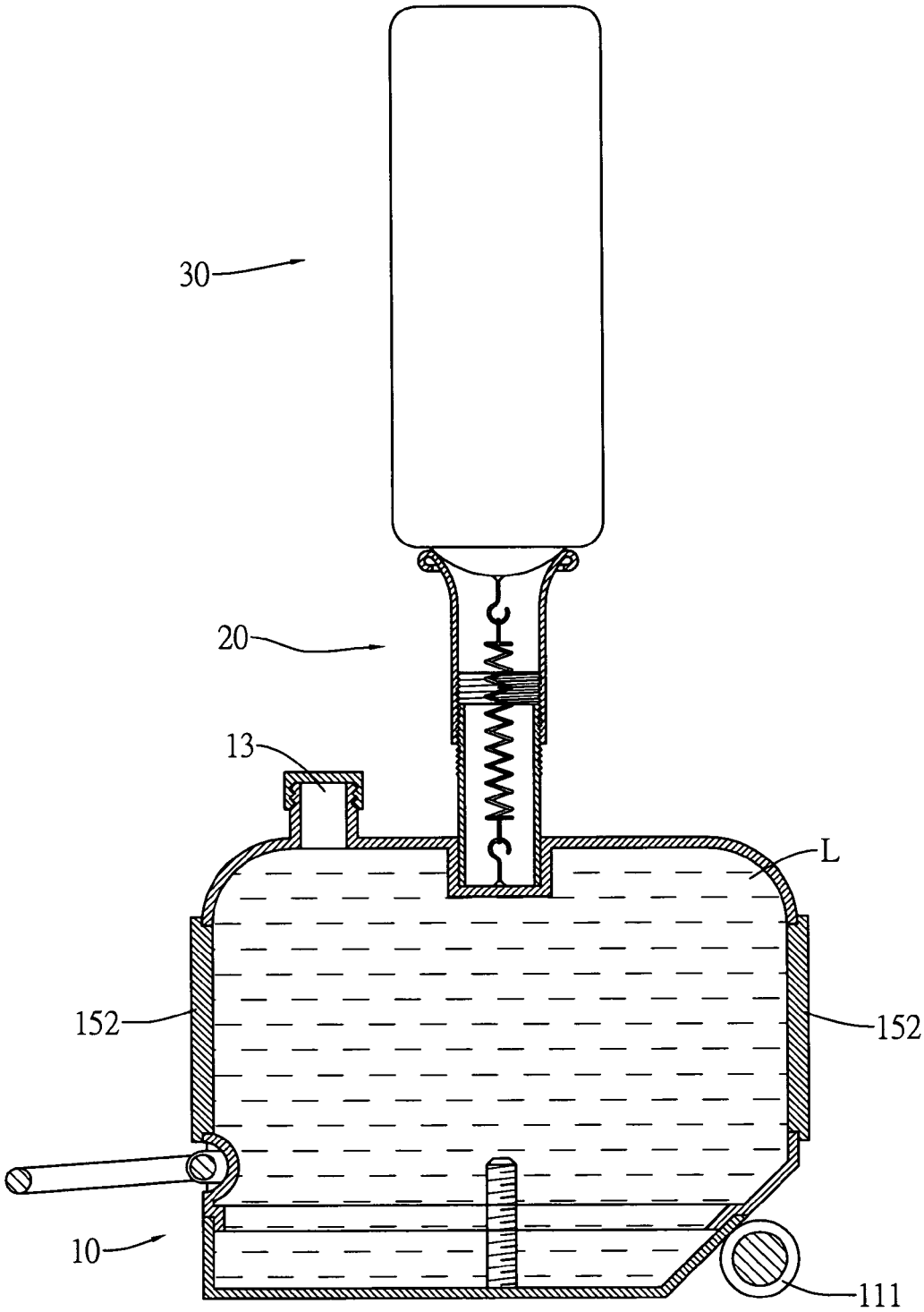
FIG. 5 is a sectional view illustrating another state of the apparatus for practicing art of attack and defense according to the present invention in use.

Referring to FIGS. 4 and 5, the hollow cylinder 22 simply engages with the Y-shaped hollow post 21 before being inserted into the recess 16 of the base 10 and the spring 23 is joined to the hook member 14 in the recess 15 at an end thereof and joined to the hook member 31 of the cylindrical member 30 at the other end thereof such that the other end of the spring 23 and the hook member 31 can be disposed at the recess part at the top of the Y-shaped hollow post 21. Due to the Y-shaped hollow post 21 being screw-joined to the hollow cylinder 22, the total length between the Y-shaped hollow post 21 and the hollow cylinder 22 is capable of being adjusted by way of regulating engagement of the outer screw threads of the hollow cylinder 22 with the inner screw threads of the Y-shaped hollow post 21. As a result, extended length of the spring 23 with restoration force is changed accordingly and the spring 23 shown in FIG. 5 is pulled in a state of being extended tightly. Therefore, it is capable of allowing the user to adjust the strength of the apparatus suitable for his/her capability.

Figure 6:
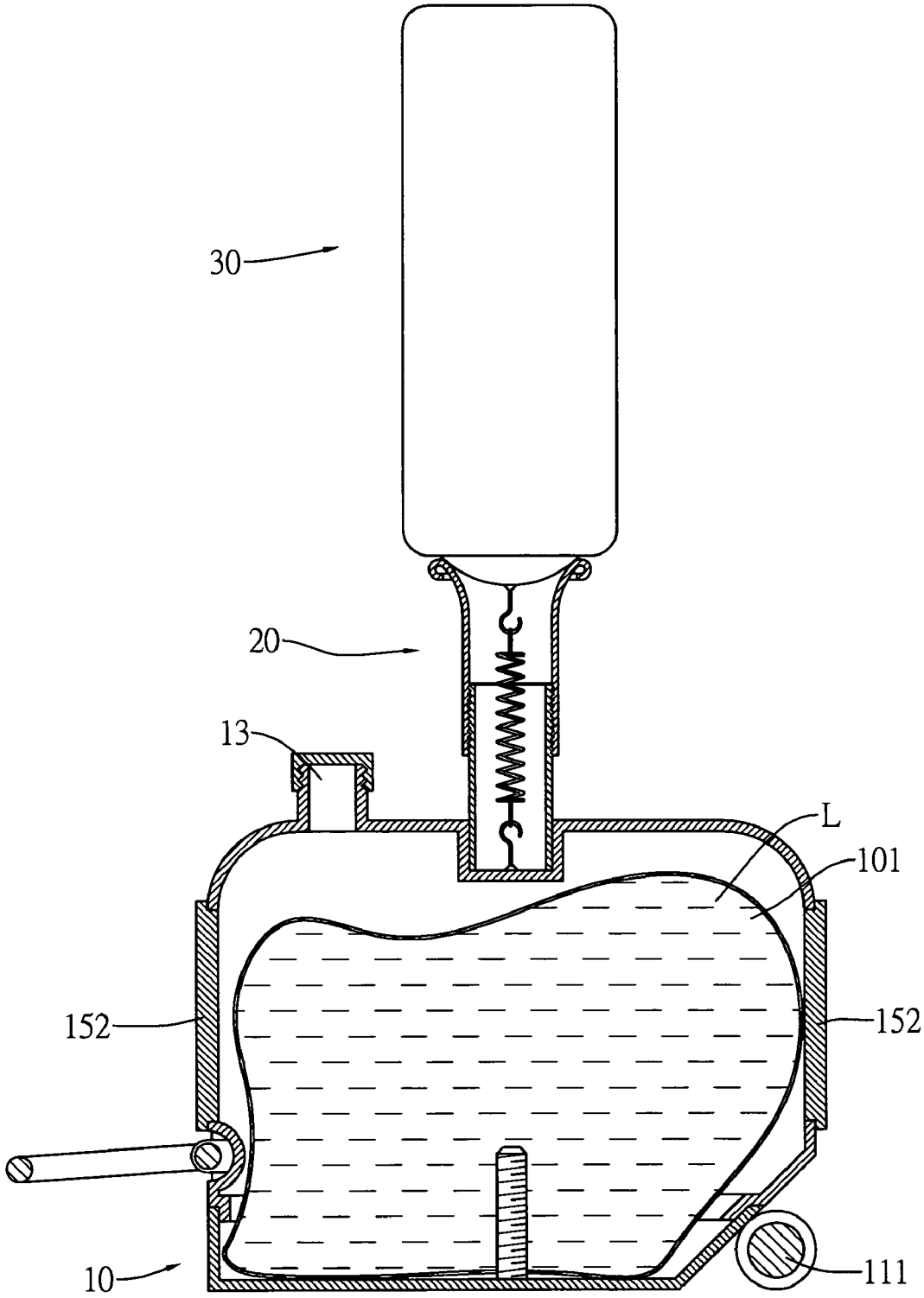
FIG. 6 is a sectional view illustrating a further state of the apparatus for practicing art of attack and defense according to the present invention in use.
Figure 7:
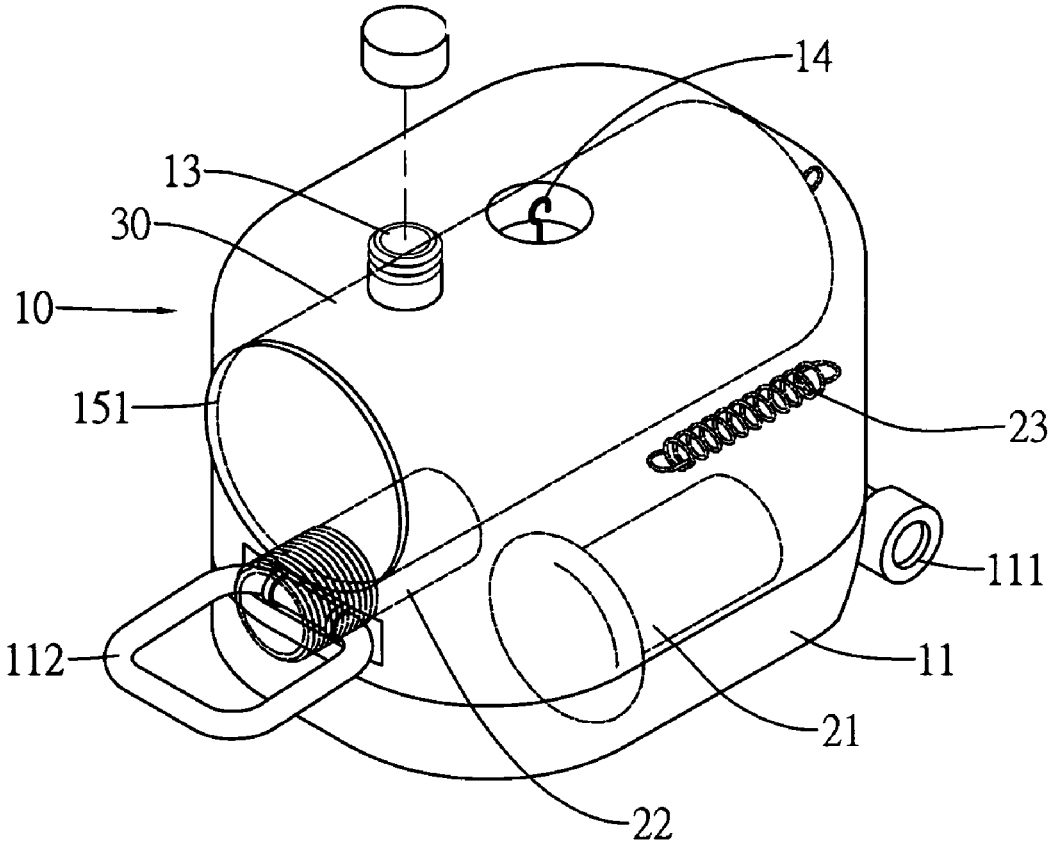
FIG. 7 is a perspective view illustrating an apparatus for practicing art of attack and defense according to the present invention being in a state of packed up.

In addition, an iron disk 114 is fastened to a stud 115 at the base 10 as shown in FIG. 3 to increase weight of the base 10 for maintaining steadiness of the base 10 without being tilted while a foreign force is exerted. Further, liquid L can be injected into the base 10 via the injection opening 13 to increase the weight of the base. Alternatively, a water bag 101 can be placed in the base 10 to increase the weight thereof as shown in FIG. 6. Further, Silicon gel or a rubber strip can be provided at the joint between the casing 15 and the base bottom 11 to prevent liquid from leaking outward. A circular piece 113 extend upward corresponding to the inlets 151 respectively to support the cylindrical member 30, which is disposed at the inlets 151 in the base. The hollow cylinder 22 and the Y-shaped hollow post 21 can be received in the base 10 as shown in FIG. 7. Once the apparatus of the present invention has been packed, the handle 112 can be used for carrying the apparatus by hand or move with the wheel set 111 conveniently.

While the invention has been described with referencing to preferred embodiments thereof, it is to be understood that modifications or variations may be easily made without departing from the spirit of this invention, which is defined by the appended claims.

What is claimed is:

1. An apparatus for practicing the art of attack and defense comprising:

a base comprising a base bottom and a casing, the casing having a recess with a first hook member;

an elastic force regulating set being disposed on the base, providing a hollow cylinder, a Y-shaped hollow post and an elastic device, the elastic device having two ends, the hollow cylinder having outer screw threads engaging with inner screw threads arranged in the Y-shaped hollow post; and a cylindrical member being disposed on the Y-shaped hollow post having a second hook member at the bottom thereof for being joined to the elastic device;

wherein the hollow cylinder engages with the Y-shaped hollow post before being inserted into the recess of the base and one end of the elastic device is joined to the first hook member and the other end of the elastic device is joined to the second hook member respectively such that one of the ends joining with the second hook member is located at an upper recess part of the Y-shaped hollow post and a total length including the Y-shaped hollow post and the hollow cylinder is adjusted by way of regulating engagement of the outer screw threads of the hollow cylinder with the inner screw threads of the Y-shaped hollow post to change the restoration force of the elastic device.

2. The apparatus for practicing the art of attack and defense as defined in claim 1, wherein the casing provides an inlet at two opposite lateral sides thereof for being inserted with the cylindrical member.

3. The apparatus for practicing the art of attack and defense as defined in claim 1, wherein the casing provides a stud for a disk being fastened to the base.

4. The apparatus for practicing the art of attack and defense as defined in claim 1, wherein two circular pieces extend upward from the base bottom.

5. The apparatus for practicing the art of attack and defense as defined in claim 1, wherein a wheel set is attached to the base bottom.

6. The apparatus for practicing the art of attack and defense as defined in claim 1, wherein a handle is provided at the casing.

7. The apparatus for practicing the art of attack and defense as defined in claim 1, wherein the casing has an injection opening.

8. The apparatus for practicing the art of attack and defense as defined in claim 1, wherein the elastic device is a spring.

9. The apparatus for practicing the art of attack and defense as defined in claim 1, wherein the Y-shaped hollow post has an outward bend at the edge on the top thereof.

10. The apparatus for practicing the art of attack and defense as defined in claim 1, wherein a joint between the casing and the base bottom is attached with a rubber seal strip.

11. The apparatus for practicing the art of attack and defense as defined in claim 1, wherein a bag with solid or/and liquid is placed in the base to increase weight thereof.

12. The apparatus for practicing the art of attack and defense as defined in claim 2, wherein a cover is provided to close the inlet to prevent liquid injected in the base from leakage.

13. The apparatus for practicing the art of attack and defense as defined in claim 3, wherein a nut is fastened to the disk member to avoid the disk member loosening from the stud.

* * * * *